US005151280A

United States Patent [19]

Arndt et al.

[11] Patent Number: 5,151,280

[45] Date of Patent: Sep. 29, 1992

[54] PELLETIZING MACHINE

[75] Inventors: Ulrich Arndt, Lauenburg; Peter Lüneburg, Berkenthien; Kurt Marquardt, Hamburg; Hans-Joachim Pierags, Lübeck; Ulrich Zeuschner, Schwarzenbek, all of Fed. Rep. of Germany

[73] Assignee: Firma Wilhelm Fette GmbH, Schwarzenbek, Fed. Rep. of Germany

[21] Appl. No.: 667,017

[22] Filed: Mar. 8, 1991

[30] Foreign Application Priority Data

Jun. 8, 1990 [DE] Fed. Rep. of Germany ..... 4018453

[51] Int. Cl.[5] ..... B30B 11/08

[52] U.S. Cl. ..... 425/186; 100/907; 425/188; 425/193; 425/345; 425/352

[58] Field of Search ..... 100/223, 251, 252, 907; 425/186, 188, 193, 344, 345, 346, 348 R, 352, 353, 354, DIG. 35

[56] References Cited

U.S. PATENT DOCUMENTS

| | | | |
|---|---|---|---|
| 2,846,723 | 8/1958 | Frank | 425/345 |
| 3,408,963 | 11/1968 | Alexander, Jr. et al. | 425/345 |
| 3,559,244 | 2/1971 | Grether et al. | 425/345 |
| 4,025,270 | 5/1977 | Beckers | 425/354 |
| 4,362,491 | 12/1982 | Livingstone | 425/186 |
| 4,988,275 | 1/1991 | Hinzpeter et al. | 425/345 |
| 5,004,413 | 4/1991 | Stopforth | 425/186 |

*Primary Examiner*—Jay H. Woo
*Assistant Examiner*—Scott Bushey
*Attorney, Agent, or Firm*—Michael J. Striker

[57] ABSTRACT

A rotary pelletizing machine has a rotatable matrix disc, a plurality of vertically adjustable pressing rollers which control position of the upper and lower plungers, a drive for a height adjustment of the rollers, a housing accommodating the drive, and a bearing block supporting the pressing roller and releasably connected with the housing.

8 Claims, 3 Drawing Sheets

PELLETIZING MACHINE

BACKGROUND OF THE INVENTION

The present invention relates to a rotary pelletizing machine.

More particularly, it relates to a rotary pelletizing machine which has a rotatably supported matrix disc, a plurality of upper and lower plungers guided in the matrix disc, and pressing rollers which control the position of the plungers in a pressing station and are supported so that they are height adjustable by a drive.

Pelletizing machines of the above mentioned general type are known in the art. In the construction of the pelletizing machine or press it is desired to form them so that a conversion of the machine for subsequent manufacturing of a different pellet type as well for cleaning of individual machine parts can be performed in shortest possible time, so that the stoppage times are very short. For this purpose it is considered as advantageous when the matrix disc together with the lower and upper plungers can be removed from the machine laterally for the exchange. This removal is however hindered by the pressing rollers which are provided in the pressing stations and especially when two pressing stations are provided, as in the case conventionally in high output machines. It has been proposed to subdivide each pressing station into a pre-pressing station and a main pressing station each having an upper pressing roller and a lower pressing roller, so that two diametrically opposite pressing stations have total eight pressing rollers.

In the known pelletizing machines the dismounting of a pressing station requires a significant time since the important components of the pressing station in the machine must be broken into its individual parts and cannot be released in the pressing station as a structural unit from the machine. Cleaning and maintenance works can also be performed only within considerable time, and after an exchange of worn parts a new adjustment must be made.

SUMMARY OF THE INVENTION

Accordingly, it is an object of the present invention to provide a rotary pelletizing machine which avoids the disadvantages of the prior art.

More particularly, it is an object of the present invention to provide a rotary pelletizing machine in which the pressing station is formed so that its significant components can be released as a structural unit or structural units from the machine, so as to be exchanged when needed by another similar unit or units, and therefore to reduce the standstill time of the machine or to simplify complete dismounting of a matrix disc.

In keeping with these objects and with others which will become apparent hereinafter, one feature of the present invention resides, briefly stated, in a rotary pelletizing machine in which a pressing roller is supported in a bearing block which is connected with the housing of its drive.

When the pelletizing machine is designed in accordance with the present invention a pressing roller with its bearing block can be separated or released from its drive with its housing connected with the machine housing, as a structural unit and removed from the machine as a structural unit. Therefore, it is possible to remove on the drive housing with both drive and control parts as a further structural unit from the machine.

In accordance with another feature of the present invention, the bearing block of the pressing roller is preferably provided with a receiving flange which is held displaceably in a guide of the housing of the drive for the pressing roller. Thus, for a dismounting of the matrix disc, only partial displacement of the pressing roller for the release of the matrix disc during its mounting is possible.

The advantages of the inventive machine also reside in the fact that the pre-pressing stations and main pressing stations can be formed uniformly and independently from one another, and removed as a structural unit from the pelletizing machine. In other words they can be maintained at a remote place so that meanwhile they can be replaced by similar parts. This is true both for the pressing rollers with their bearing and as an enclosed structural unit, as well also for the drive housing with the drive for the pressing roller which must be worked after being separated from the pelletizing machine, for the purpose of change of maintenance, an exchange of the matrix disc, cleaning or repair.

A further advantage of the above mentioned divisibility is obtained when during a dismounting of a pressing roller it is not necessary to release all electrical conductors and to remove the end switches and therefore it is not necessary to adjust again the whole pressing station.

In accordance with still another feature of the present invention, the receiving flange has a column, in which the bearing block is guided in a height adjustable manner.

The drive housing for the pressing roller can be releasably connected with a housing of the pelletizing machine.

A transmission can be arranged in the drive housing for lifting and lowering of the pressing roller.

The transmission can be formed as a worm gear transmission and cooperate with an adjusting spindle which carries the bearing block of the pressing roller.

Finally, the adjusting spindle can have a force measuring device on which the bearing block of the pressing roller is supported.

The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
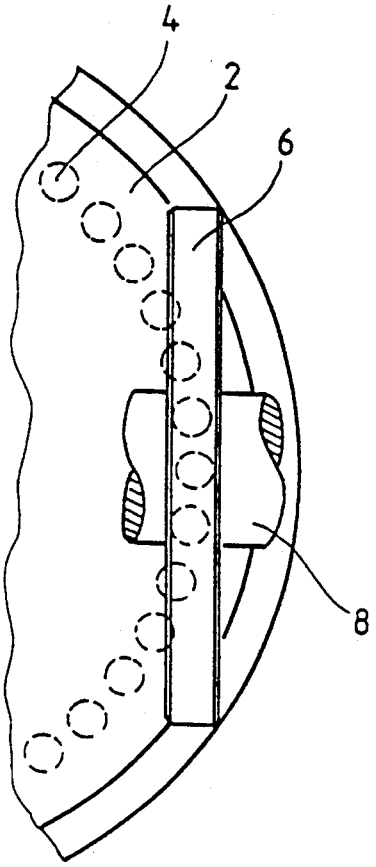
FIG. 1 is a partial plan view of a matrix disc with a pressing rolling, of a rotary pelletizing machine in accordance with the present invention.
Figure 2:
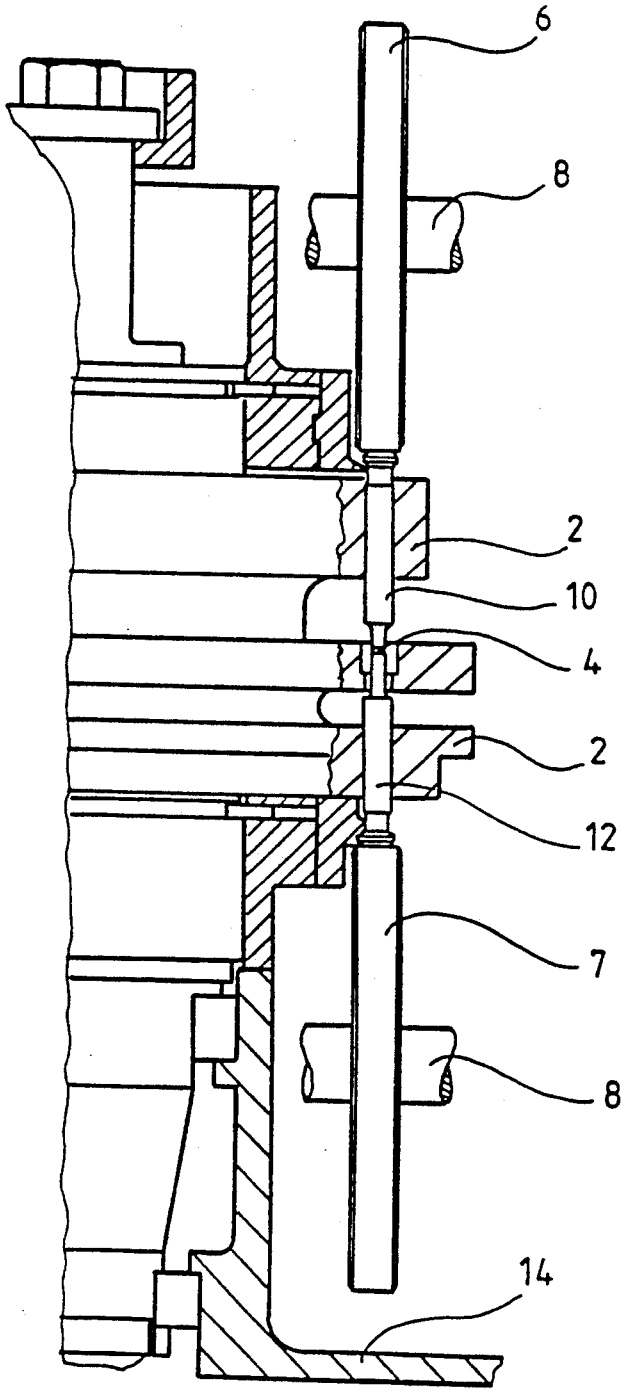
FIG. 2 is a partial section of the rotary pelletizing machine in accordance with the present invention.

A rotary pelletizing machine in accordance with the present invention has a rotatable matrix disc which is identified with reference numeral 2. The matrix disc 2 is provided with a plurality of matrix openings uniformly distributed over its periphery. Pellets are pressed in the matrix opening 4 of the matrix disc 2. The compression is performed by upper plungers 10 and lower plungers 12 in so-called pressing stations. The pressing stations are subdivided into a pre-pressing station and a main pressing station. Each pressing station has an upper pressing roller 6 and a lower pressing roller 7 which are held on a shaft 8. The shafts 8 are vertically adjustable by a drive which is releasably mounted on a stationary machine housing 14.

Figure 3:
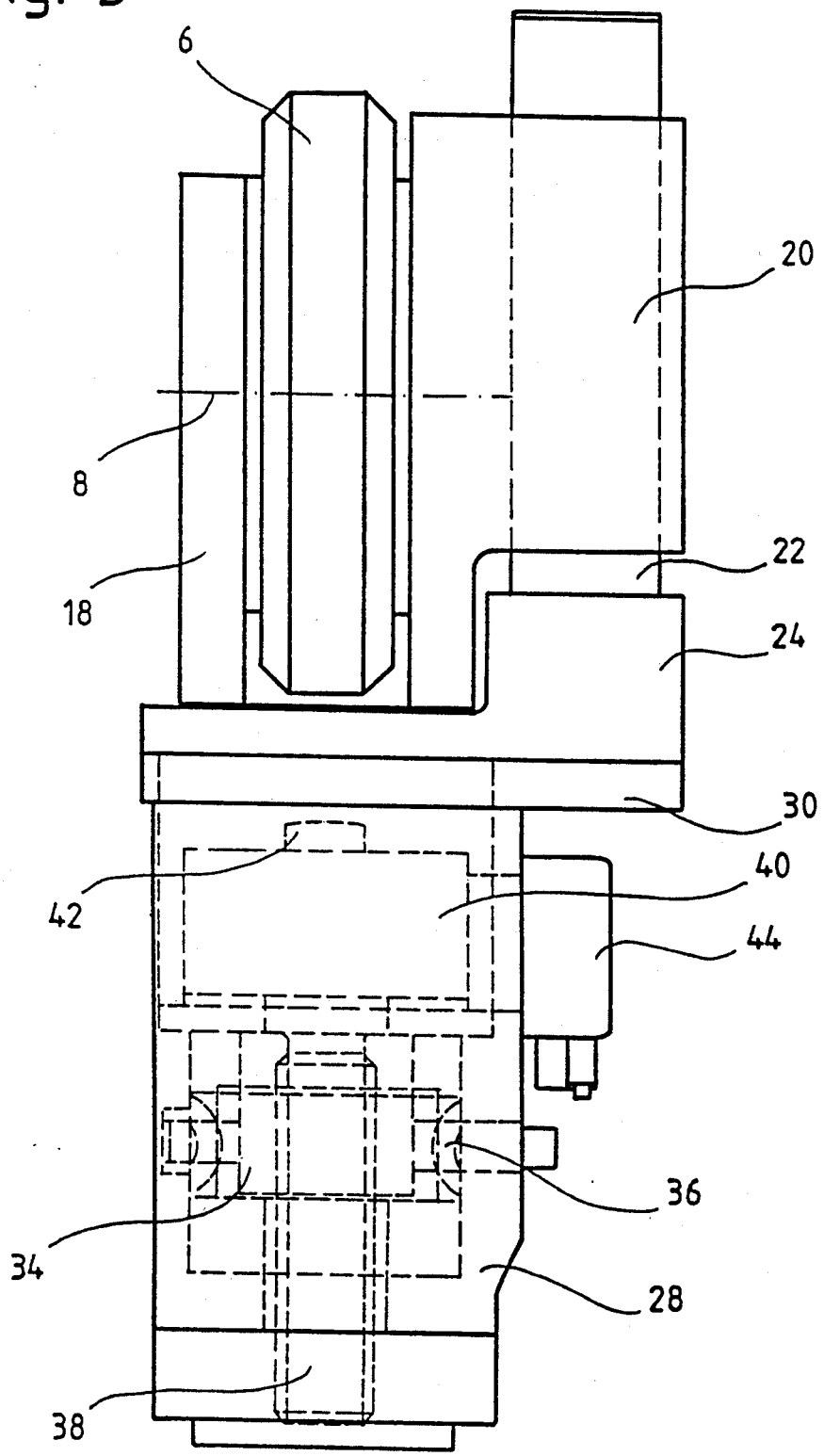
FIG. 3 is a view showing a pressing roller with a drive of the inventive pelletizing machine, in a working position.
Figure 4:
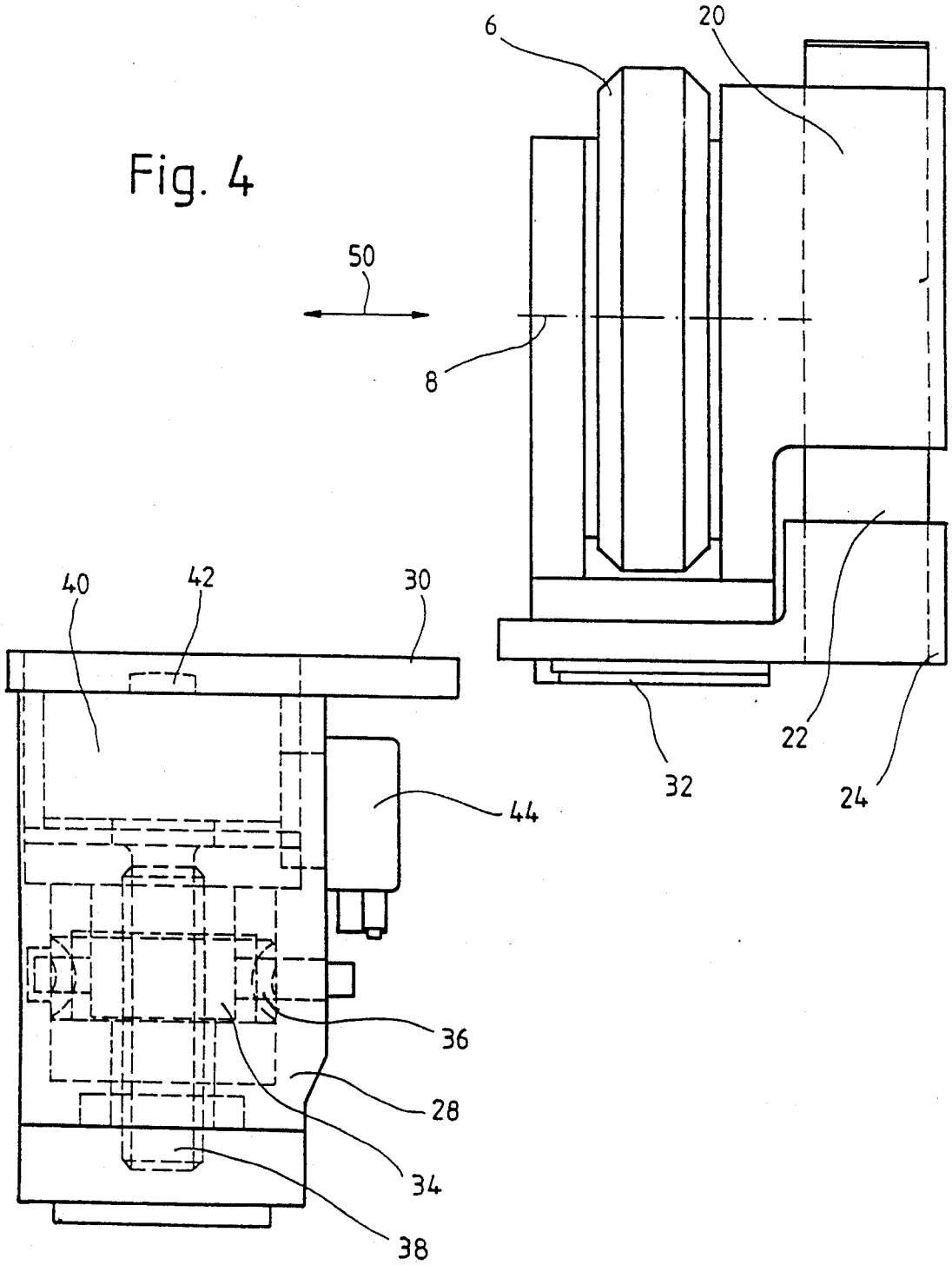
FIG. 4 is a view showing a pressing roller with its drive in a disassembled position.

As shown in FIGS. 3 and 4, the pressing roller 6 is held in a bearing block 18. The bearing block 18 is provided with a linear guide 20 which is vertically adjustable on a column 22. The column 22 is supported by a receiving flange 24 which is releasably connected with a drive housing 28 for the height adjustment of the pressing roller 6. For this purpose the drive housing 28 is provided with a rail-like guide 30. The guide 30 cooperates with a rail-like, substantially dove-tail-shaped counterguide 32 in the bottom of the receiving flange so that the receiving flange 24 together with the column 22, the linear guide 20, and the bearing block 18 and therefore the pressing roller 6 and can be completely released from the drive housing 28 in direction of the arrow 50.

A partial radial adjustment is advantageous when the matrix disc 2 together with the upper plungers 10 and the lower plungers 12 must be turned out of the machine for their cleaning or their exchange. In this case the turning movement is not hindered by the pressing roller 6 which is located in its working position.

A complete separation of the pressing roller 6 with its bearing block 8 and its linear guide 20 from the drive housing is performed when the pressing rollers with their bearings must be worked for example for the purpose of maintenance. After such a complete release there is the possibility to release the drive housing 28 with its components as a completely self-contained structural unit from the pelletizing machine and in some cases, for saving the time, exchanged by a similar structural unit.

A height adjustable spindle 38 for adjusting of the pressing roller 6 is also a component of the drive in the housing 28. The adjustment is performed by a worm wheel 34 which cooperates with a worm 36. The adjustment can be performed manually or mechanically. The spindle 38 carries a force measuring device 40 with a pressing mushroom projection 42, on which the bearing block 18 is supported directly or indirectly.

A plurality of cable connections for measurement and control of a device are not shown in the drawings. They are connected to the housing 28 through an end switch 44. For releasing the pressing roller 6 or for separating of its drive, the adjusting spindle 38 in correspondence with FIG. 4 is moved so that the receiving flange 24 together with the bearing block 18 can be withdrawn from the guide 30 in direction of the arrow 50.

It will be understood that each of the elements described above, or two or more together, may also find a useful application in other types of constructions differing from the types described above.

While the invention has been illustrated and described as embodied in a rotary pelletizing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A rotary pelletizing machine, comprising a rotatable matrix disc; a plurality of upper and lower plungers guided in said matrix disc; a plurality of vertically adjustable pressing rollers which control position of said upper and lower plungers; a drive housing; a drive in said drive housing for a height adjustment of said rollers; a bearing block supporting said pressing rollers; and means for releasably connecting said bearing block and therefore said pressing rollers supported in said bearing block with said drive housing of said drive for a height adjustment to facilitate exchange of said matrix disc.

2. A rotary pelletizing machine as defined in claim 1, wherein said matrix has an axis of rotation, said bearing block being displaceable in a radial direction relative to said axis of rotation of said matrix disc relative to said housing.

3. A rotary pelletizing machine as defined in claim 1; and further comprising a machine housing, said drive housing being releasably connected with said machine housing.

4. A rotary pelletizing machine as defined in claim 1; and further comprising a transmission arranged in said housing and operative for lifting and lowering said pressing rollers.

5. A rotary pelletizing machine, comprising a rotatable matrix disc; a plurality of upper and lower plungers guided in said matrix disc; a plurality of vertically adjustable pressing rollers which control position of said upper and lower plungers; a drive housing; a drive in said drive housing for a height adjustment of said rollers; a bearing block supporting said pressing rollers; and means for releasably connecting said bearing block and therefore said pressing rollers supported in said bearing block with said drive housing of said drive for a height adjustment to facilitate exchange of said matrix disc, said housing having a guide, said bearing block having a receiving flange and being displaceably supported with said receiving flange in said guide of said housing.

6. A rotary pelletizing machine as defined in claim 5, wherein said receiving flange has a column on which said bearing block is guided in a height-adjustable manner.

7. A rotary pelletizing machine, comprising a rotatable matrix disc; a plurality of upper and lower plungers guided in said matrix disc; a plurality of vertically adjustable pressing rollers which control position of said upper and lower plungers; a drive housing; a drive in said drive housing for a height adjustment of said rollers; a bearing block supporting said pressing rollers; means for releasably connecting said bearing block and therefore said pressing rollers supported in said bearing block with said drive housing of said drive for a height adjustment to facilitate exchange of said matrix disc; a transmission arranged in said housing and operative for lifting and lowering said pressing rollers, said transmission being formed as a worm transmission; and an adjustable spindle which carries said bearing block, said worm transmission cooperating with said adjustable spindle.

8. A rotary pelletizing machine as defined in claim 7, wherein said adjusting spindle carries a force measuring device on which said bearing block is supported.

* * * * *